US006716115B2

(12) United States Patent
Isogawa et al.

(10) Patent No.: US 6,716,115 B2
(45) **Date of Patent: *Apr. 6, 2004**

(54) THREAD WOUND GOLF BALL

(75) Inventors: Kazuhiko Isogawa, Kobe (JP); Keiji Moriyama, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/162,684

(22) Filed: Jun. 6, 2002

(65) Prior Publication Data

US 2003/0092508 A1 May 15, 2003

(30) Foreign Application Priority Data

Jun. 6, 2001 (JP) ..... 2001-171035

(51) Int. Cl.[7] ..... A63B 37/06; A63B 37/00
(52) U.S. Cl. ..... 473/357; 473/351
(58) Field of Search ..... 473/351–378

(56) References Cited

U.S. PATENT DOCUMENTS 5,704,853 A * 1/1998 Maruko et al. ..... 473/363
5,752,888 A * 5/1998 Maruko et al. ..... 473/361
5,762,568 A * 6/1998 Kato ..... 473/365
5,766,096 A * 6/1998 Maruko et al. ..... 473/365
5,772,530 A * 6/1998 Kato ..... 473/363
5,823,888 A * 10/1998 Maruko et al. ..... 473/354
5,848,942 A * 12/1998 Kato ..... 473/365
5,853,337 A 12/1998 Moriyama et al.
5,888,151 A * 3/1999 Hayashi ..... 473/363
6,054,550 A * 4/2000 Umezawa et al. ..... 528/76
6,095,932 A * 8/2000 Umezawa et al. ..... 473/356
6,142,885 A * 11/2000 Umezawa et al. ..... 473/365
6,210,291 B1 4/2001 Kato et al.
6,475,103 B1 * 11/2002 Kato ..... 473/357
6,497,630 B1 * 12/2002 Hebert et al.
6,527,651 B1 * 3/2003 Umezawa et al.

FOREIGN PATENT DOCUMENTS

JP 9-271537 A 10/1997
JP 9-271539 A 10/1997
JP 10-201881 A 8/1998

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

The present invention provides a thread wound golf ball having long flight distance, while maintaining the characteristics of good shot feel and excellent spin performance. The golf ball of the present invention comprises a thread wound core composed of a solid center and a thread rubber layer formed on the solid center, and a cover covering the thread wound core, wherein if the diameter of the solid center is A (mm), a thickness of the thread rubber layer is B (mm) and a thickness of the cover is C (mm), A, B and C satisfy a correlation represented by the following four formulae: $36.5 \leqq A \leqq 39.0$, $1.0 \leqq B \leqq 2.0$, $1.0 \leqq C \leqq 2.0$, $B+C \leqq 3.5$ and the cover has a Shore D hardness of 50 to 60.

3 Claims, 1 Drawing Sheet

THREAD WOUND GOLF BALL

FIELD OF THE INVENTION

The present invention relates to a thread wound golf ball. More particularly, it relates to a thread wound golf ball having long flight distance, while maintaining the characteristics peculiar to the conventional thread wound golf ball, i.e. good shot feel and excellent spin performance.

BACKGROUND OF THE INVENTION

Thread wound golf balls consist of a solid or liquid center, a thread wound layer formed on the center and a cover of ionomer resin or balata etc. covering on the thread wound layer. The thread wound golf ball, when compared with the solid golf ball such as two-piece golf ball, generally has better shot feel at the time of hitting and better controllability at approach shot because of excellent spin performance. The thread wound golf ball is generally approved of or employed by high level golfers, especially professional golfers, who regard the characteristics as most important. However, the thread wound golf ball is inferior in flight distance to the solid golf ball, because the thread wound golf ball has large spin amount and small launch angle. Therefore the thread wound golf ball having sufficient flight distance, while maintaining the advantage of good shot feel and excellent controllability, is required.

In order to solve the problem, a thread wound golf ball comprising a solid center, thread rubber layer and cover, which has further long flight distance while maintaining excellent shot feel and controllability by adjusting material and physical properties of the solid center, such as a diameter, hardness, hardness distribution and deformation amount; and a hardness of the cover; to suitable ranges, has been proposed (Japanese Patent Kokai Publication Nos. 271537/1997, 271539/1997, 201881/1998, 299935/1999 and the like).

In Japanese Patent Kokai publication No. 271537/1997, a thread wound golf ball, of which the solid center has a diameter of 30 to 38 mm, a surface hardness in JIS-C hardness of 40 to 80 and a hardness difference from the central point to the surface in JIS-C hardness of not more than 5, and the cover is formed from a base resin comprising ionomer resin as a main component and has a flexural modulus of 300 to 600 MPa and a Shore D hardness of 60 to 80, is described.

In Japanese Patent Kokai publication No. 271539/1997, a thread wound golf ball, of which the solid center has a diameter of 35 to 38 mm and a deformation amount of 3.5 to 6.0 mm when applying a load of 130 kg (initial load of 10 kg), a deformation amount difference from that of the solid center to that of the golf ball is within the range of 0.5 to 3 mm, and the cover has a Shore D hardness of 65 to 75, is described. In the golf ball, the spin amount of is restrained, and the flight distance is increased.

In Japanese Patent Kokai publication No. 201881/1998, a thread wound golf ball, of which the solid center has a diameter of 30 to 38 mm, a surface hardness in JIS-C hardness of 40 to 90, a hardness difference from the central point to the surface in JIS-C hardness of not more than 5 and a deformation amount of 0.5 to 2.5 mm when applying a load of 30 kg (initial load of 10 kg), and the cover is formed from a base resin comprising ionomer resin as a main component and has a flexural modulus of 50 to 300 MPa and a Shore D hardness of not less than 40 to less than 60, is described. In the golf ball, it is easy to put spin thereon when hit by an iron club.

In Japanese Patent Kokai publication No. 299935/1999, a thread wound golf ball, of which the cover has a two-layer structure composed of an inner cover and an outer cover having higher hardness than the inner cover, the outer cover has a Shore D hardness of 55 to 65, a total thickness of the inner cover and outer cover is within the range of 2.0 to 5.0 mm, the thread rubber layer has a thickness of 1.0 to 2.5 mm, and the solid center has a diameter of 29 to 37 mm. In the both golf ball, the scuff resistance when hit by an iron club is excellent and the spin performance, shot feel and flight distance when hit by a driver are improved.

However, in order to improve the flight distance in the conventional thread wound golf ball with solid center, it has been proposed to soften the solid center to restrain the spin amount, or to increase the diameter of the solid center and heighten the cover hardness, as described above. The flight distance is improved, but the spin performance is poor. When the thread wound golf ball is prepared by using soft center, while maintaining the characteristics peculiar to the thread wound golf ball, i.e. excellent spin performance by using soft cover, the hardness of the golf ball is low, and the rebound characteristics are degraded. In order to restrain the deterioration of the rebound characteristics, it is required to increase an extension of a thread rubber when winding the thread rubber around the solid center, and there is problem that the thread rubber easily breaks at the process of winding it.

Therefore, the thread wound golf ball, which has sufficient flight distance as same as solid golf balls, while maintaining the advantage of good shot feel and excellent controllability in the thread wound golf balls, has not been obtained. The thread wound golf ball having further excellent shot feel and controllability and long flight distance is required.

OBJECTS OF THE INVENTION

A main object of the present invention is to provide a thread wound golf ball, of which the flight distance is improved, while maintaining good shot feel and excellent spin performance.

According to the present invention, the object described above has been accomplished in a thread wound golf ball comprising a solid center by adjusting a diameter of the solid center, a thickness of the thread rubber layer and a thickness and hardness of the cover to a specified range, thereby providing a thread wound golf ball, of which the flight distance is improved as long as possible, while maintaining the characteristics peculiar to the thread wound golf ball, i.e. good shot feel and spin performance.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
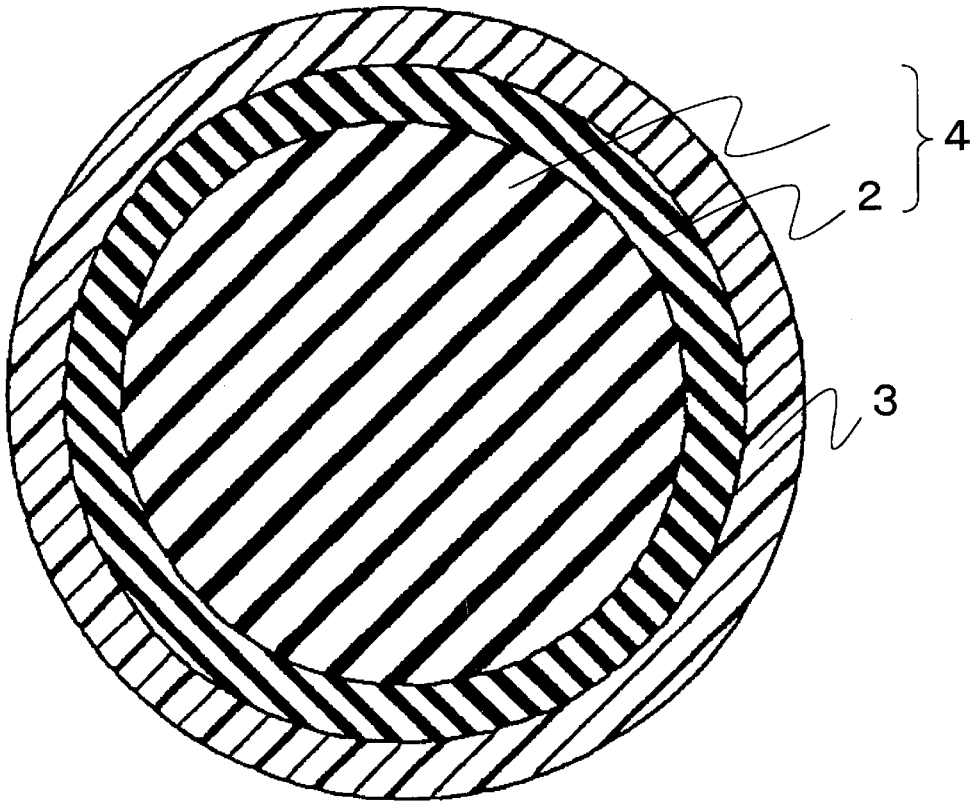
FIG. 1 is a schematic cross section illustrating one embodiment of the golf ball of the present invention.

The present invention provides a thread wound golf ball comprising a thread wound core composed of a solid center and a thread rubber layer formed on the solid center, and a cover covering the thread wound core, wherein assuming that a diameter of the solid center is A (mm), a thickness of the thread rubber layer is B (mm) and a thickness of the cover is C (mm), the A, B and C satisfy a correlation represented by the following four formulae:

$$36.5 \leqq A \leqq 39.0$$

$$1.0 \leqq B \leqq 2.0$$

$$1.0 \leqq C \leqq 2.0$$

$$B+C \leqq 3.5$$

and the cover has a hardness in Shore D hardness of 50 to 60.

In order to put the present invention into a more suitable practical application, it is desired that a surface hardness in Shore D hardness of the solid center be higher than a central point hardness in Shore D hardness of the solid center by 20 to 40;

the solid center have a deformation amount of 3.3 to 3.9 mm when applying from an initial load of 98 N to a final load of 1275 N;

the golf ball have a deformation amount of 2.6 to 3.1 mm when applying from an initial load of 98 N to a final load of 1275 N.

DETAILED DESCRIPTION OF THE INVENTION

The thread wound golf ball of the present invention will be explained with reference to the accompanying drawing in detail. FIG. 1 is a schematic cross section illustrating one embodiment of the golf ball of the present invention. As shown in FIG. 1, the golf ball of the present invention comprises a thread wound core 4 composed of a solid center 1 and a thread rubber layer 2 formed on the solid center, and a cover 3 covering the thread wound core 4.

In the golf ball of the present invention, the solid center 1 is formed from a rubber composition comprising a base rubber, a co-crosslinking agent, organic peroxide, filler and the like. The base rubber may be natural rubber and/or synthetic rubber, which has been conventionally used for solid golf balls. Preferred is high-cis polybutadiene rubber containing a cis-1,4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

Examples of the co-crosslinking agents include a metal salt of α, β-unsaturated carboxylic acid, particularly mono- or di-valent metal salts, such as zinc or magnesium salts of α, β-unsaturated carboxylic acids having 3 to 8 carbon atoms (e.g. acrylic acid, methacrylic acid, etc.). The preferred co-crosslinking agent is zinc acrylate, because it imparts high rebound characteristics to the resulting golf ball. The amount of the co-crosslinking agent may be 10 to 40 parts by weight, preferably 15 to 35 parts by weight, based on 100 parts by weight of the base rubber. When the amount of the co-crosslinking agent is larger than 40 parts by weight, the solid center is too hard, and the shot feel of the resulting golf ball is poor. On the other hand, when the amount of the co-crosslinking agent is smaller than 10 parts by weight, the solid center is too soft, and the rebound characteristics of the resulting golf ball are degraded, which reduces the flight distance.

Examples of the organic peroxides, which acs as a crosslinking agent or hardener, include dicumyl peroxide, 1,1-bis(t-butylperoxy)-3,3,5-trimethylcyclohexane, 2,5-dimethyl-2,5-di(t-butylperoxy)-hexane, di-t-butyl peroxide and the like. The preferred organic peroxide is dicumyl peroxide. The amount of the organic peroxide is from 0.5 to 2.0 parts by weight, preferably 0.8 to 1.5 parts by weight, based on 100 parts by weight of the base rubber. When the amount of the organic peroxide is smaller than 0.5 parts by weight, the solid center is too soft, and the rebound characteristics are degraded, which reduces the flight distance. On the other hand, when the amount of the organic peroxide is larger than 2.0 parts by weight, the solid center is too hard, and the shot feel is poor.

Examples of the fillers, which can be used for the core of the golf ball, include for example, inorganic filler (such as zinc oxide, barium sulfate, calcium carbonate, and the like), high specific gravity metal powder filler (such as tungsten powder, molybdenum powder, and the like), and the mixture thereof. The amount of the filler is from 20 to 70 parts by weight, preferably 25 to 60 parts by weight, based on 100 parts by weight of the base rubber. When the amount of the filler is smaller than 20 parts by weight, the center is too light, and the weight of the resulting golf ball is too small. On the other hand, when the amount of the filler is larger than 70 parts by weight, the center is too heavy, and the weight of the resulting golf ball is too large.

In the golf ball of the present invention, the rubber composition for the solid center 1 can contain other components, which have been conventionally used for preparing the core of solid golf balls, such as antioxidant or peptizing agent. If used, the amount of the antioxidant is preferably 0.2 to 0.5 parts by weight, based on 100 parts by weight of the base rubber.

The solid center 1 is obtained by mixing the rubber composition, followed by vulcanizing and press-molding the mixture in a mold, for example, at 150 to 170° C. for 10 to 20 minutes.

In the golf ball of the present invention, it is required for the solid center 1 to have a diameter of 36.5 to 39.0 mm, preferably 36.5 to 38.5 mm, more preferably 36.6 to 38.0 mm. When the diameter of the solid center 1 is smaller than 36.5 mm, the spin amount is large, which reduces the flight distance. On the other hand, when the diameter of the solid center is larger than 39.0 mm, the thread rubber layer is too thin, and the technical effects of improving rebound characteristics accomplished by the presence of the thread rubber layer are not sufficiently obtained, which reduces the flight distance.

In the golf ball of the present invention, it is desired for the solid center 1 to have a surface hardness in JIS-C hardness higher than a central point hardness in JIS-C hardness by 20 to 40, and the hardness difference is preferably 22 to 39, more preferably 24 to 38. When the hardness difference is smaller than 20, the launch angle is small and the spin amount is large, which reduces the flight distance. On the other hand, when the hardness difference is larger than 40, the center is too hard, and the rebound characteristics of the resulting golf ball are degraded, which reduces the flight distance.

In the golf ball of the present invention, it is desired for the solid center 1 to have a central point hardness in JIS-C hardness of 40 to 60, preferably 42 to 60, more preferably 44 to 60. When the central point hardness is lower than 40, the center is too soft, and a proper hardness of the resulting golf ball is not sufficiently obtained, which degrades the rebound characteristics. On the other hand, the central point hardness is higher than 60, the center is too hard, and the shot feel of the resulting golf ball is poor. The term "a central point hardness of the solid center" as used herein refers to the hardness, which is obtained by cutting the center into two equal parts and then measuring a hardness at central point in section.

In the golf ball of the present invention, it is desired for the solid center 1 to have the surface hardness in JIS-C hardness of 70 to 90, preferably 73 to 87, more preferably 75 to 85. When the surface hardness is lower than 70, the center is too soft, and a proper hardness of the resulting golf ball is not sufficiently obtained, which degrades the rebound characteristics. On the other hand, when the surface hardness is higher than 90, the center is too hard, and the shot feel of the resulting golf ball is poor. The term "a surface hardness of the solid center" as used herein refers to the hardness, which is determined by measuring a hardness at the surface of the resulting solid center.

In the golf ball of the present invention, it is desired for the solid center 1 to have a deformation amount when applying from an initial load of 98 N to a final load of 1275 N of 3.3 to 3.9 mm, preferably 3.4 to 3.8 mm, more preferably 3.4 to 3.7 mm. When the deformation amount is smaller than 3.3 mm, the launch angle is low and the spin amount is large, which reduces the flight distance. On the other hand, when the deformation amount is larger than 3.9 mm, the center is too soft, and a proper hardness of the resulting golf ball is not sufficiently obtained. Therefore the rebound characteristics are degraded, which reduces the flight distance.

The thread rubber layer 2 is then formed on the solid center 1 by winding thread rubber for golf balls around the resulting solid center 1 to obtain a thread wound core 4. The thread rubber used for winding around the solid center 1 may be of the same kind which is conventionally used in thread wound layers in thread wound golf balls; e.g., it can be obtained by vulcanizing a rubber composition in which natural rubber or natural rubber and synthetic polyisoprene have been compounded with sulfur, a vulcanization aid, vulcanization accelerator, antioxidant and the like. The thread rubber layer 2 is formed on the solid center 1 by conventional methods which have been used for preparing the thread wound core of the thread wound golf balls.

In the golf ball of the present invention, it is required for the thread rubber layer 2 to have a thickness of 1.0 to 2.0 mm, preferably 1.1 to 2.0 mm, more preferably 1.2 to 1.9 mm. When the thickness of the thread rubber layer is smaller than 1.0 mm, the thread rubber layer is too thin to exhibit sufficient rebound characteristics, which reduces the flight distance. On the other hand, when the thickness is larger than 2.0 mm, the spin amount at the time of hitting increases, which reduces the flight distance.

The cover 3 is then formed on the thread wound core 4. As the materials used in the cover 3 of the golf ball of the present invention, ionomer resin, which has been conventionally used for covers of golf balls, may be used, but the ionomer resin may be used in combination with at least one of thermoplastic elastomer, diene block copolymer and the like.

The ionomer resin used in the present invention is not limited, but includes a copolymer of ethylene and α, β-unsaturated carboxylic acid, of which at least a portion of carboxylic acid groups is neutralized with metal ion; a terpolymer of ethylene, α, β-unsaturated carboxylic acid and α, β-unsaturated carboxylic acid ester, of which at least a portion of carboxylic acid groups is neutralized with metal ion; or mixtures thereof. Examples of the α, β-unsaturated carboxylic acid in the ionomer, for example, include acrylic acid, methacrylic acid, fumaric acid, maleic acid, crotonic acid and the like. Preferred are acrylic acid and methacrylic acid. Examples of the α, β-unsaturated carboxylic acid ester in the ionomer, for example, include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. Examples of the metal ions, which neutralizes a portion of carboxylic acid groups of the copolymer or terpolymer, include a sodium ion, a potassium ion, a lithium ion, a magnesium ion, calcium ion, a zinc ion, a barium ion, an aluminum ion, a tin ion, a zirconium ion, a cadmium ion and the like. Preferred are sodium ion, zinc ion, magnesium ion and the like, in view of rebound characteristics, durability and the like.

The ionomer resin is not limited, but examples thereof will be shown by trade names. Examples of the ionomer resin, which is commercially available from Du Pont-Mitsui Polychemicals Co., Ltd., include Hi-milan 1555, Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which is commercially available from Du Pont Co., include Surlyn 8140, Surlyn 9120, Surlyn 8945, Surlyn 9945, Surlyn AD8511, Surlyn AD8512, Surlyn AD8542, Surlyn 6320 and the like. Examples of the ionomer resin, which is commercially available from Exxon Chemical Co., include Iotek 7010, Iotek 8000, and the like. The ionomers may each be used alone or in combinations of two or more.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based thermoplastic elastomer, which is commercially available from BASF Polyurethane Elastomers Co., Ltd. under the trade name of "Elastollan" (such as "Elastollan ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010"), the diene block copolymers, which are commercially available from Kuraray Co., Ltd. under the trade name of "Septon" (such as "Septon HG-252") and the like.

When the ionomer resin is used in combination with the thermoplastic elastomer or diene block copolymer in the cover 3 of the golf ball of the present invention, the amount of the thermoplastic elastomer or diene block copolymer is 0 to 60 parts by weight, preferably 10 to 40 parts by weight, based on 100 parts by weight of the base resin for the cover. When the amount is larger than 60 parts by weight, the cover is too soft and the rebound characteristics are degraded, or the compatibility with the ionomer resin is degraded and the durability is degraded.

In the golf ball of the present invention, the resin composition for the cover 3 may optionally contain the same fillers as used in the solid center 1, pigments (such as titanium dioxide, etc.), and the other additives (such as dispersants, antioxidants, UV absorbers, photostabilizers and fluorescent agents or fluorescent brighteners, etc.), in addition to the resin component, as long as the addition of the additives does not deteriorate the desired performance of the golf ball cover, but an amount of the pigment is preferably from 1.0 to 6.0 parts by weight based on 100 parts by weight of the cover base resin.

The cover 3 of the present invention may be formed by conventional methods, which have been known to the art and used for forming the cover of the golf balls. For example, there can be used a method comprising molding the cover composition into a semi-spherical half-shell in advance, covering the thread wound core with the two half-shells, followed by pressure molding at 130 to 170° C. for 1 to 5 minutes, or a method comprising injection molding the cover composition directly on the thread wound core to cover it.

In the golf ball of the present invention, it is required for the cover 3 to have a thickness of 1.0 to 2.0 mm, preferably 1.1 to 2.0 mm, more preferably 1.2 to 1.9 mm. When the thickness of the cover is smaller than 1.0 mm, the cover is too thin, and the durability of the resulting golf ball is degraded. On the other hand, when the thickness is larger than 2.0 mm, the spin amount of the resulting golf ball is large, which reduces the flight distance.

In the golf ball of the present invention, it is required that the sum (B+C) of the thickness of the thread rubber layer 2 (B) and that of the cover 3 (C) be within the range of not more than 3.5 mm, preferably not more than 3.4 mm, more preferably not more than 3.1 mm. When the sum (B+C) is larger than 3.5 mm, either the thread rubber layer 2 or the cover 3 is thick, and the spin amount of the resulting golf ball is large, which reduces the flight distance.

In the golf ball of the present invention, it is required for the cover 3 to have a hardness in Shore D hardness of 50 to 60, preferably 50 to 59, more preferably 51 to 58. When the cover hardness is lower than 50, the spin amount at the time of hitting is large, which reduces the flight distance. On the other hand, when the cover hardness is higher than 60, the cover is too hard, the shot feel of the resulting golf ball is poor.

At the time of molding the cover, many depressions called "dimples" are formed on the surface of the golf ball. Furthermore, paint finishing or marking with a stamp may be optionally provided after the cover is molded for commercial purposes.

In the golf ball of the present invention, it is desired to have a deformation amount when applying from an initial load of 98 N to a final load of 1275 N of 2.6 to 3.1 mm, preferably 2.7 to 3.1 mm, more preferably 2.7 to 3.0 mm. When the deformation amount is smaller than 2.6 mm, the golf ball is too hard, and the shot feel is hard and poor. On the other hand, when the deformation amount is larger than 3.1 mm, the golf ball is too soft, and the rebound characteristics are degraded, which reduces the flight distance.

EXAMPLES

The following Examples and Comparative Examples further illustrate the present invention in detail but are not to be construed to limit the scope of the present invention.

Production of Solid Center

The rubber compositions for the solid center 1 having the formulations shown in Tables 1 and 2 were mixed, and then vulcanized by press-molding at the vulcanization condition shown in the same Tables to obtain spherical solid centers. The diameter, weight, central point hardness (a), surface hardness (b) and deformation amount of the resulting solid center 1 were measured, and the hardness difference (b−a) was determined by calculation. The results are shown in the same Tables.

TABLE 1

| | (parts by weight) | | | |
|---|---|---|---|---|
| Center composition | I | II | III | IV |
| BR18 *1 | 100 | 100 | 100 | 100 |
| Zinc acrylate | 28 | 28 | 32 | 28 |
| Zinc oxide | 10.2 | 10.2 | 9.5 | 13.8 |
| Dicumyl peroxide | 0.9 | 0.9 | 0.9 | 0.9 |
| Diphenyl disulfide | 0.5 | 0.5 | 0.5 | 0.5 |
| Barium sulfate | 20.8 | 20.8 | 20.8 | 20.8 |
| Vulcanization condition | | | | |
| Temperature (° C.) | 170 | 160 | 170 | 170 |
| Time (min) | 23 | 23 | 23 | 23 |
| Diameter (mm) | 37.0 | 37.0 | 37.0 | 36.0 |
| Weight (g) | 32.4 | 32.4 | 32.4 | 30.6 |
| Center hardness (JIS - C) | | | | |
| Central point hardness (a) | 56 | 64 | 57 | 58 |
| Surface hardness (b) | 83 | 80 | 83 | 83 |
| (b-a) | 27 | 16 | 26 | 25 |
| Deformation amount (mm) | 3.6 | 3.6 | 3.2 | 3.6 |

TABLE 2

| | (parts by weight) | | | |
|---|---|---|---|---|
| Center composition | V | VI | VII | VIII |
| BR18 *1 | 100 | 100 | 100 | 100 |
| Zinc acrylate | 28 | 28 | 28 | 28 |
| Zinc oxide | 11.8 | 11.6 | 5.2 | 5.2 |
| Dicumyl peroxide | 0.9 | 0.9 | 0.9 | 0.9 |
| Diphenyl disulfide | 0.5 | 0.5 | 0.5 | 0.5 |
| Barium sulfate | 20.8 | 20.8 | 20.8 | 18.0 |
| Vulcanization condition | | | | |
| Temperature (° C.) | 170 | 170 | 170 | 170 |
| Time (min) | 23 | 23 | 23 | 23 |
| Diameter (mm) | 36.5 | 36.6 | 38.0 | 38.8 |
| Weight (g) | 31.6 | 31.7 | 34.2 | 36.0 |
| Center hardness (JIS - C) | | | | |
| Central point hardness (a) | 58 | 58 | 58 | 58 |
| Surface hardness (b) | 83 | 83 | 83 | 83 |
| (b-a) | 25 | 25 | 25 | 2.5 |
| Deformation amount (mm) | 3.6 | 3.6 | 3.6 | 3.6 |

*1: High-cis polybutadiene commercially available from JSR Co., Ltd. under the trade name of "BR 18"; Content of 1,4-cis-polybutadiene: 96%

Formation of Thread Rubber Layer

The thread rubber layer was then formed on the solid center by winding the thread rubber having a width of 1.5 mm and thickness of 0.5 mm around the solid center to obtain the thread wound core having a thickness of the thread rubber layer shown in Tables 4 to 6. The thread rubber was prepared from a blend of natural rubber and a low cis-isoprene rubber ("Shell IR-309" commercially available from Shell Chemical Co., Ltd.) =50/50 (weight ratio) as a base rubber.

Preparation of Cover Composition

The formulation materials for the cover shown in Table 3 were mixed using a kneading type twin-screw extruder to obtain pelletized cover compositions. The extrusion condition were a screw diameter of 45 mm, a screw speed of 200 rpm, and a screw L/D of 35.

The formulation materials were heated at 200 to 260° C. at the die position of the extruder. The hardness were determined, using a sample of a stack of the three or more heat and press molded sheets having a thickness of about 2 mm from the cover composition, which had been stored at 23° C. for 2 weeks, with a Shore D hardness meter according to ASTM D 2240-68. The results are shown as a cover hardness in Tables 3 to 6.

TABLE 3

| Cover composition | (parts by weight) i | ii | iii | iv |
|---|---|---|---|---|
| Surlyn 8945 *2 | 30 | 35 | 25 | 50 |
| Surlyn 9945 *3 | 30 | 35 | 25 | 50 |
| Epofriend A1010 *4 | 10 | 7 | 15 | — |
| Septon HG - 252 *5 | 30 | 23 | 35 | — |
| Titanium dioxide | 4 | 4 | 4 | 4 |
| Cover hardness (Shore D) | 51 | 54 | 46 | 63 |

*2: Surlyn 8945 (trade name), ethylene-methacrylic acid copolymer ionomer resin obtained by neutralizing with sodium ion, manufactured by Du Pont Co., Shore D hardness = 61

*3: Surlyn 9945 (trade name), ethylene-methacrylic acid copolymer ionomer resin obtained by neutralizing with zinc ion, manufactured by Du Pont Co., Shore D hardness = 59

*4: Epofriend A1010 (trade name), styrene-butadiene-styrene (SBS) structure block copolymer having a polybutadiene block with epoxy groups, manufactured by Daicel Chemical Industries, Ltd., styrene/butadiene (weight ratio) = 40/60, JIS-A hardness = 70, content of epoxy: about 1.5 to 1.7% by weight

*5: Septon HG-252 (trade name), hydrogenated styrene-isoprene-styrene block copolymer having a terminal OH group, manufactured by Kuraray Co., Ltd., JIS-A hardness = 80, content of styrene = about 40% by weight Examples 1 to 8 and Comparative Examples 1 to 7

The cover compositions were covered on the resulting core by injection molding to form a cover layer having a thickness shown in Tables 4 to 6. Then, clear paint was applied on the surface to produce thread wound golf balls having a diameter of 42.8 mm and weight of 45.4 g. With respect to the resulting golf balls, the deformation amount, flight performance (launch angle, spin amount and flight distance), shot feel and durability were measured or evaluated, and the results are shown in Tables 4 to 6. The test methods are as follows.

Test Methods (1) Hardness (i) Center Hardness

The surface hardness of the center is determined by measuring JIS-C hardness at the surface of the center. The central point hardness of the center is determined by measuring JIS-C hardness at the central point of the center in section, after the center is cut into two equal parts. The JIS-C hardness was measured with a JIS-C hardness meter according to JIS K 6301.

(ii) Cover Hardness

The hardness of the cover was determined by measuring a hardness, using a sample of a stack of the three or more heat and press molded sheets having a thickness of about 2 mm from each cover composition, which had been stored at 23° C. for 2 weeks, with a Shore D hardness meter according to ASTM D-2240.

(2) Deformation Amount

The deformation amount is determined by measuring a deformation amount, when applying from an initial load of 98 N to a final load of 1275 N on the center, core or golf ball.

(3) Flight Performance

After a No. 1 wood club (W#1, a driver) having metal head was mounted to a swing robot manufactured by True Temper Co. and a golf ball was hit at head speed of 50 m/sec, the launch angle, spin amount (backspin) and flight distance were measured. As the flight distance, total that is a distance to the firstly dropping point on the ground of the hit golf ball was measured. The measurement was conducted 12 times for each golf ball (n=12), and the average is shown as the result of the golf ball.

(4) Shot Feel

The shot feel of the golf ball is evaluated by 10 golfers according to a practical hitting test using a No. 1 wood club (a driver) having metal head. The evaluation criteria are as follows.

Evaluation criteria:

○: Not less than 8 out of 10 golfers felt that the golf ball has soft and good shot feel.

Δ: From 3 to 7 out of 10 golfers felt that the golf ball has soft and good shot feel.

×: Not less than 8 out of 10 golfers felt that the golf ball has large impact force, and hard and poor shot feel.

(5) Durability

A No.1 wood club (W#1, a driver) having metal head was mounted to a swing robot manufactured by True Temper Co. and the resulting golf ball was hit at a head speed of 45 m/second to strike against an impact board, repeatedly. The durability is determined by measuring the number of hit until the cover of the golf ball cracks, and is expressed as an index, with the value of the index in Example 1 being taken as 100. The larger the value is, the better durability the golf ball has.

Test Results

TABLE 4

| Test item | Example No. 1 | 2 | 3 | 4 | 5 |
|---|---|---|---|---|---|
| (Center) | | | | | |
| Composition | I | I | I | VI | VI |
| Diameter (mm) | 37.0 | 37.0 | 37.0 | 36.6 | 36.6 |
| Hardness (JIS - C) | | | | | |
| Central point hardness (a) | 56 | 56 | 56 | 58 | 58 |
| Surface hardness (b) | 83 | 83 | 83 | 83 | 83 |
| (b-a) | 27 | 27 | 27 | 25 | 25 |
| Deformation amount (mm) | 3.6 | 3.6 | 3.6 | 3.6 | 3.6 |

TABLE 4-continued

| Test item | Example No. 1 | 2 | 3 | 4 | 5 |
|---|---|---|---|---|---|
| (Thread rubber layer) | | | | | |
| Thickness (mm) | 1.3 | 1.6 | 1.3 | 1.9 | 1.2 |
| (Cover) | | | | | |
| Composition | i | i | ii | i | i |
| Thickness (mm) | 1.6 | 1.3 | 1.6 | 1.2 | 1.9 |
| Hardness (Shore D) | 51 | 51 | 54 | 51 | 51 |
| (Golf ball) | | | | | |
| Deformation amount (mm) | 2.9 | 2.9 | 2.9 | 2.9 | 2.9 |
| (Flight performance) | | | | | |
| Launch angle (degree) | 9.9 | 9.8 | 10.0 | 9.6 | 10.0 |
| Spin amount (rpm) | 2300 | 2400 | 2200 | 2500 | 2200 |
| Flight distance (m) | 234 | 232 | 235 | 232 | 234 |
| Shot feel | ○ | ○ | ○ | ○ | ○ |
| Durability | 100 | 100 | 98 | 96 | 105 |

TABLE 5

| Test item | Example No. 6 | 7 | 8 | Comparative Example No. 1 | 2 |
|---|---|---|---|---|---|
| (Center) | | | | | |
| Composition | VII | II | III | I | I |
| Diameter (mm) | 38.0 | 37.0 | 37.0 | 37.0 | 37.0 |
| Hardness (JIS - C) | | | | | |
| Central point hardness (a) | 58 | 64 | 57 | 56 | 56 |
| Surface hardness (b) | 83 | 80 | 83 | 83 | 83 |
| (b-a) | 25 | 16 | 26 | 27 | 27 |
| Deformation amount (mm) | 3.6 | 3.6 | 3.2 | 3.6 | 3.6 |
| (Thread rubber layer) | | | | | |
| Thickness (mm) | 1.2 | 1.3 | 1.3 | 1.3 | 1.3 |
| (Cover) | | | | | |
| Composition | i | i | i | iii | iv |
| Thickness (mm) | 1.2 | 1.6 | 1.6 | 1.6 | 1.6 |
| Hardness (Shore D) | 51 | 51 | 51 | 46 | 63 |
| (Golf ball) | | | | | |
| Deformation amount (mm) | 2.9 | 2.9 | 2.8 | 3.0 | 2.8 |
| (Flight performance) | | | | | |
| Launch angle (degree) | 10.1 | 9.6 | 9.7 | 9.6 | 10.0 |
| Spin amount (rpm) | 2100 | 2600 | 2400 | 2800 | 2100 |
| Flight distance (m) | 236 | 230 | 231 | 224 | 235 |
| Shot feel | ○ | ○ | Δ | ○ | x |
| Durability | 96 | 100 | 98 | 100 | 95 |

TABLE 6

| Test item | Comparative Example No. 3 | 4 | 5 | 6 | 7 |
|---|---|---|---|---|---|
| (Center) | | | | | |
| Composition | IV | V | VIII | VIII | V |
| Diameter (mm) | 36.0 | 36.5 | 38.8 | 38.8 | 36.5 |
| Hardness (JIS - C) | | | | | |
| Central point hardness (a) | 58 | 58 | 58 | 58 | 58 |
| Surface hardness (b) | 83 | 83 | 83 | 83 | 83 |

TABLE 6-continued

| Test item | Comparative Example No. 3 | 4 | 5 | 6 | 7 |
|---|---|---|---|---|---|
| (b-a) | 25 | 25 | 25 | 25 | 25 |
| Deformation amount (mm) | 3.6 | 3.6 | 3.6 | 3.6 | 3.6 |
| (Thread rubber layer) | | | | | |
| Thickness (mm) | 1.9 | 2.15 | 0.8 | 1.2 | 1.0 |
| (Cover) | | | | | |
| Composition | i | i | i | i | i |
| Thickness (mm) | 1.5 | 1.0 | 1.2 | 0.8 | 2.15 |
| Hardness (Shore D) | 51 | 51 | 51 | 51 | 51 |
| (Golf ball) | | | | | |
| Deformation amount (mm) | 2.9 | 2.9 | 3.0 | 3.0 | 2.9 |
| (Flight performance) | | | | | |
| Launch angle (degree) | 9.5 | 9.4 | 10.0 | 10.0 | 9.5 |
| Spin amount (rpm) | 2700 | 2800 | 2200 | 2100 | 2700 |
| Flight distance (m) | 224 | 222 | 226 | 236 | 224 |
| Shot feel | ○ | ○ | Δ | ○ | ○ |
| Durability | 100 | 97 | 100 | 80 | 105 |

As is apparent from Table 4 to Table 6, in the golf balls of the present invention of Examples 1 to 8, the flight distance is improved while maintaining good shot feel and excellent spin performance, when compared with the golf balls of Comparative Examples 1 to 7.

In the golf balls of Example 8 having excellent performance compared with the golf ball of Comparative Examples, which is within the scope of the present invention, since the deformation amount of the solid center and golf ball is small, the shot feel is slightly poor among the golf balls of Examples.

On the other hand, in the golf ball of Comparative Example 1, since the cover hardness is low, the spin amount is large, which reduces the flight distance. In the golf ball of Comparative Example 2, since the cover hardness is high, the cover is too hard, and the shot feel is poor. In the golf ball of Comparative Example 3, since the diameter of the solid center is small, the launch angle is low and the spin amount is large, which reduces the flight distance.

In the golf ball of Comparative Example 4, since the thickness of the thread rubber layer is large, the spin amount is large, which reduces the flight distance. In the golf ball of Comparative Example 5, since the thickness of the thread rubber layer is small, the flight distance is short. In the golf ball of Comparative Example 6, since the thickness of the cover is small, the cover is too thin, and the durability is largely degraded. In the golf ball of Comparative Example 7, since the thickness of the cover is large, the spin amount is large, which reduces the flight distance.

What is claimed is:

1. A thread wound golf ball comprising a thread wound core comprising a solid center and a thread rubber layer formed on the solid center, and a cover covering the thread wound core, wherein assuming that a diameter of the solid center is A (mm), a thickness of the thread rubber layer is B (mm) and a thickness of the cover is C (mm), A, B and C satisfy a correlation represented by the following four formulae:

$$36.5 \leqq A \leqq 39.0;$$

$$1.0 \leqq B \leqq 2.0;$$

$$1.0 \leqq C \leqq 2.0;$$

and $$B+C \leqq 3.5;$$

and the cover has a Shore D hardness of 50 to 60, and a surface hardness in JIS-C hardness of the solid center is higher than a central point hardness of the solid center in JIS-C hardness by 20 to 40.

2. A thread wound golf ball comprising a thread wound core comprising a solid center and a thread rubber layer formed on the solid center, and a cover covering the thread wound core, wherein assuming that a diameter of the solid center is A (mm), a thickness of the thread rubber layer is B (mm) and a thickness of the cover is C (mm), A, B and C satisfy a correlation represented by the following four formulae:

$$36.5 \leqq A \leqq 39.0;$$

$$1.0 \leqq B \leqq 2.0;$$

$$1.0 \leqq C \leqq 2.0;$$

and $$B+C \leqq 3.5;$$

and the cover has a Shore D hardness of 50 to 60, and wherein the solid center has a deformation amount of 3.3 to 3.9 mm when applying from an initial load of 98 N to a final load of 1275 N.

3. A thread wound golf ball comprising a thread wound core composed of a solid center and a thread rubber layer formed on the solid center, and a cover covering the thread wound core, wherein assuming that a diameter of the solid center is A (mm), a thickness of the thread rubber layer is B (mm) and a thickness of the cover is C (mm), A, B and C satisfy a correlation represented by the following four formulae:

$$36.5 \leqq A \leqq 39.0;$$

$$1.0 \leqq B \leqq 2.0;$$

$$1.0 \leqq C \leqq 2.0;$$

and $$B+C \leqq 3.5;$$

and the cover has a Shore D hardness of 50 to 60, and wherein the golf ball has a deformation amount of 2.6 to 3.1 mm when applying from an initial load of 98 N to a final load of 1275 N.

* * * * *